US005894191A

United States Patent [19]

Kim

[11] Patent Number: 5,894,191

[45] Date of Patent: Apr. 13, 1999

[54] ELECTRODE SYSTEM FOR CONTROLLING ELECTROSTATIC FIELD IN ELECTRON GUN FOR COLOR CATHODE RAY TUBE

[75] Inventor: Hyun Chul Kim, Kyungsangbuk-do, Rep. of Korea

[73] Assignee: LG Electronics, Rep. of Korea

[21] Appl. No.: 08/863,895

[22] Filed: May 28, 1997

[30] Foreign Application Priority Data

May 28, 1996 [KR] Rep. of Korea ..... 96-18286

[51] Int. Cl.[6] ..... H01J 29/50

[52] U.S. Cl. ..... 313/412; 313/414

[58] Field of Search ..... 313/414, 412, 313/449, 426, 432, 460

[56] References Cited

U.S. PATENT DOCUMENTS

| | | | |
|---|---|---|---|
| 5,015,911 | 5/1991 | Cho | 313/414 |
| 5,023,508 | 6/1991 | Park | 313/414 |
| 5,142,189 | 8/1992 | Sugahara et al. | 313/414 |
| 5,146,133 | 9/1992 | Shirai et al. | 313/414 |
| 5,212,423 | 5/1993 | Noguchi et al. | 313/414 |
| 5,300,854 | 4/1994 | Kweon | 313/414 |
| 5,300,855 | 4/1994 | Kweon | 313/414 |
| 5,414,323 | 5/1995 | Uchida et al. | 313/414 |
| 5,488,265 | 1/1996 | Chen | 313/414 |
| 5,506,468 | 4/1996 | Koh | 313/414 |
| 5,512,797 | 4/1996 | Kim et al. | 313/414 |
| 5,572,085 | 11/1996 | Choi | 313/414 |

FOREIGN PATENT DOCUMENTS

| | | |
|---|---|---|
| 59-215640 | 12/1984 | Japan . |
| 89-3825 | 10/1989 | Rep. of Korea . |

*Primary Examiner*—Ashok Patel
*Attorney, Agent, or Firm*—Fish & Richardson PC

[57] ABSTRACT

The electrode system controls an electrostatic field in an electron gun for a color cathode ray tube having cathodes for emitting three electron beams, a two division first and second focusing electrodes and an anode for focusing and accelerating the three electron beams onto a screen. The system includes electrostatic field controlling electrodes in the anode and the second focusing electrode disposed opposite to the anode. Each of the electrostatic field controlling electrodes includes a center frame having a center electron beam pass-through hole, and outer frames extending from both sides of the center frame to form outer electron beam pass-through holes, wherein each one of the electrostatic field controlling electrodes is disposed in contact with the inside of the second focusing electrode and the anode, and a disposed depth from a rim portion of the second focusing electrode and the anode and thicknesses of the center frame and the outer frames in a travel direction of the electron beams are adjusted to minimize deflection aberrations of the three electron beams.

10 Claims, 6 Drawing Sheets

ELECTRODE SYSTEM FOR CONTROLLING ELECTROSTATIC FIELD IN ELECTRON GUN FOR COLOR CATHODE RAY TUBE

BACKGROUND OF THE INVENTION

1. Field of the Invention

The present invention relates to an electron gun for a color cathode ray tube, and more particularly, to an electrode system for controlling an electrostatic field in an electron gun for a color cathode ray tube, which can improve astigmatisms and OCV(Outer Beam Convergence Variance), particularly on periphery of the screen, that occur when electron beams are deflected, to improve the resolution of the color cathode ray tube.

2. Discussion of the Related Art

The electron gun in a color cathode ray tube is an electron beam emitting device which forms a pixel by focusing three electron beams emitted from respective cathodes onto red, green and blue fluorescent surfaces at a front part of the cathode ray tube such that each of the surfaces reacts with a respective electron beams, thereby forming an image on the screen through combination of the pixels.

FIG. 1 illustrates an outline of the color cathode ray tube provided with a conventional in-line type electron gun.

Referring to FIG. 1, the color cathode ray tube has a panel 1 of glass forming a front surface thereof and a funnel 2 of which the front portion is fusion welded to a rear portion of the panel 1. The funnel, converges to form a neck portion 2*a* at the rear end of the tube in which an electron gun 3 is sealed. There is a fluorescent surface 5 on the inside of the panel 1 having red, green, blue fluorescent materials coated thereon for illumination by electron beams 4 emitted from the electron gun. There is also a shadow mask 6 that is perforated with electron beam pass-through holes 61 for selective pass through of the three electron beams 4 and is spaced a certain distance apart from the panel 1. There are deflection yokes 7 on an outer circumference of the neck portion 2*a* for deflecting the electron beams 4 to the panel 1, i.e., to regions of the screen.

FIG. 2 illustrates the conventional in-line type electron beam shown in FIG. 1 with a partial cut-away view.

Referring to FIG. 2, the conventional electron gun includes three cathode ray electrodes 8 each having a heater (not shown), a controlling electrode 9 which is a first grid electrode for controlling the electron beams, an accelerating electrode 10 which is a second grid electrode for accelerating the electron beams, pre-focus electrodes 11 and 12 which are third and fourth grid electrodes for pre-focusing the electron beams, a focusing electrode and anode 13 and 14 which are fifth and sixth grid electrodes for finally focusing and accelerating the electron beams, and a shield cup 16 disposed at one end of the anode 14 in the direction of the screen for shielding leakage magnetic fields from the deflection, and the foregoing electrodes are fixed by one pair of bead glass with predetermined distances spaces between them. The focusing electrode 13 has a first focusing electrode 131 to which a static voltage is applied and a second focusing electrode to which a dynamic voltage is applied.

In the operation of the electron gun, when a predetermined voltage is applied to each of the electrodes and currents are applied to the cathode electrodes 8, heaters in the cathode electrodes 8 are heated to emit thermal electron beams 4, which are accelerated toward the screen by a voltage difference between the accelerating electrode 10 and the controlling electrode 9. Then, the electron beams 4 are pre-focused by the pre-focusing electrodes 11 and 12 and finally focused and accelerated by a main electrostatic focusing lens formed by a voltage difference between the second focusing electrode 132 and the anode 14. Thereafter, the electron beams 4 are deflected by the deflection yokes 7, pass through the electron beam pass-through holes 61 in the shadow mask 6, and collide onto the fluorescent surface to form a pixel. The larger the size of the main electrostatic focusing lens, the more exact the focusing of the electron beams, resulting in a sharper image on the screen. However, the small diameter of about 5.5~5.9 mm of the main focusing electrostatic lens causes a spherical aberration, which causes hazing of the electron beams that degrades the resolution of the color cathode ray tube. The spherical aberration is proportional to an inverted third power of the diameter of the main electrostatic focusing lens, and the diameter of the main electrostatic focusing lens is substantially proportional to diameters of the electron beam pass-through holes in the second focusing electrode 132 and the anode 14. Therefore, in general, to lower the spherical aberration, it has been suggested that the diameters of the electron beam pass-through holes in the second focusing electrode 132 and the anode 14 should made greater, resulting in a larger main electrostatic focusing lens.

FIG. 3 illustrates a perspective view of an example of a conventional second focusing electrode 132 and the anode 14 in a partial cut away view FIG. 4 illustrates a frontal section of the system shown in FIG. 3, together with the neck portion for reference.

Referring to FIGS. 3 and 4, the diameter of each of the three electron beam pass-through holes 132*c* and 132*s*, in the second focusing electrode 132 and 14*c* and 14*s* in the anode 14 respectively formed on a plane perpendicular to a center axis of the neck portion 2*a* is limited to less than ⅓ of the inside diameter of the neck portion 2*a*, because the second focusing electrode 132 and the anode 14 should be disposed in the neck portion 2*a*. Accordingly, in the aforementioned electron gun for a color cathode ray tube, in order increase the diameter, D, of the electron beam pass-through holes 132*c*, 132*s*, 14*c* and 14*s* that form the main electrostatic focusing lens, the inside diameter L of the neck portion 2*a* should be made greater, the gap g between the outside circumferences of the second focusing electrode 132 and the anode 14 and the neck portion 2*a*, and the widths I, and $I_2$ of the bridges of the electron beam pass-through holes 132*c* and 132*s*, 14*c* and 14*s* should be minimized. The distances between the electron beam pass-through holes 132*c*, 132*s*, 14*c* and 14*s*, i.e., the beam separation S should be made greater. However, there are limitations placed on the reduction of the gap, because an electrical insulation should be maintained between the second focusing electrode 132, the anode 14 and the neck portion 2*a*. There are limitations on the reduction of the widths $1_1$ and $1_2$ of the bridges because of strength of the bridges. Also, cases in which the inside diameter L of the neck portion 2*a* is made greater and the beam separations S are made greater, causes higher deflection power consumption for the deflection yokes and degraded resolution due to weakened convergence of the electron beams, due to the greater beam separation S. Therefore, a design that can provide the largest electron beam pass-through holes D, while the inside diameter L of the neck portion 2*a* is maintained, is required.

FIG. 5 illustrates a perspective view of another example of a conventional second focusing electrode 132 and anode 14 having electrostatic field controlling electrodes provided therein, with a partial cut away view, and FIG. 6 illustrates a section of the conventional second focusing electrode 132 and anode 14 shown in FIG. 5, wherein the same reference numbers are used for identical parts explained before.

Referring to FIGS. 5 and 6, electrode barrels 132*d* and 14*d* and electrostatic field controlling electrodes 17 and 18 are disposed in respective electrode barrels and adapted to receive the same voltage as the respective electrode barrel. Outer ends of the electrode barrels 132*d* and 14*d* are opened such that the three electron beams may pass in common, and inner ends thereof, disposed oppositely, are also opened in the same manner. The inner ends each have a rim portion 132*e* and 14*e* formed thereon along an inside circumference, with an inside wall of a predetermined length extended inwardly into the second focusing electrode 132 and the anode 14. Each of the electrostatic field controlling electrodes 17 and 18, disposed at a position away from the rim portion 132*d* and 14*d* by a predetermined distance c and a and arranged vertically with respect to the direction of travel of the electron beams, includes a flat portion 17*b* and 18*b* having a center electron beam pass-through hole 17*a* and 18*a*, and blades 17*c* and 18*c* bent at a right angle to the flat portion 17*b* and 18*b* at both ends of the flat portion 17*b* and 18*b*.

Accordingly, the center electron beam entering into the second focusing electrode passes through the center electron beam pass-through hole 17*a*, and the outer electron beams pass through the spaces between the inside of the electrode barrel 132*d* and the blade 17*c*. The electron beams then pass through the anode in the same manner as the second focusing electrode. In this case, as the openings defined by the rim portions 132*f* and 14*f* of the second focusing electrode 132 and anode 14 are large in diameter, the diameter of the main focusing electrostatic lens can be made large, but with the horizontal diameter being much larger than the vertical diameter. Because of this, the horizontal focusing power is significantly weakened compared to the vertical focusing power, which changes the focus distance and causes an astigmatism. However, the electrostatic field controlling electrodes 17 and 18 project an electrostatic field into the openings, which prevents the occurrence of the astigmatism to some extent. The additional fields formed by the blades 17*c* and 18*c*, which have certain widths at both sides of the center electron beam pass-through holes 17*a* and 18*a* affect, the horizontal focusing power of the main focusing electrostatic lens. As the positions of the electrostatic field controlling electrodes 17 and 18 are deeper in the second focusing electrode 132 and the anode 14, i.e., the farther from the rim portions 132*e* and 14*e*, the electric field between the two electrostatic field controlling electrodes 17 and 18 becomes weaker with formation a greater slope of equipotential lines, and the diameter of the main focusing electrostatic lens can be increased.

However, the deeper positioning of the electrostatic field controlling electrodes for obtaining a larger diameter main focusing electrostatic lens causes the following problems.

First, the deeper positioning of the electrostatic field controlling electrode in the second focusing electrode results in a negative tendency of the astigmatism, i.e., underfocusing of the electron beams in the horizontal direction and overfocusing in the vertical direction. Causing a vertical dispersion of the image and reducing the OCV, which represents a convergence of outer beams.

Second, the deeper positioning of the electrostatic field controlling electrode in the anode results in a positive tendency of the astigmatism, i.e., overfocusing of the electron beams in the horizontal direction and underfocusing in the vertical direction. Causing a horizontal dispersion of the image and increasing the OCV, which represents a convergence of outer beams.

Even though the aforementioned problems can be solved to some extent by positioning the electrostatic field controlling electrodes appropriately, there is a limitation on the extent of the improvements in astigmatism and OCV that can be realized solely by adjustment of the positions of the electrostatic field controlling electrodes.

SUMMARY OF THE INVENTION

Accordingly, the present invention is directed to an electrode system for controlling an electrostatic field in an electron gun for a color cathode ray tube that substantially obviates one or more of the problems due to limitations and disadvantages of the related art.

An object of the present invention is to provide an electrode system for controlling an electrostatic field in an electron gun for a color cathode ray tube, which can improve astigmatisms and OCV, particularly on the periphery of the screen that occur when electron beams are deflected, to improve the resolution of the color cathode ray tube.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, the invention as embodied and broadly described, the electrode system for controlling an electrostatic field in an electron gun for a color cathode ray tube having electron beam emitting means for emitting three electron beams, a two division first and second focusing electrodes and an anode for focusing and accelerating the three electron beams onto a screen. The electrode system includes an electrostatic field controlling electrodes in the anode and the second focusing electrode disposed opposite to the anode, each of the electrostatic field controlling electrode including a center frame having a center electron beam pass-through hole, and outer frames extending from both sides of the center frame to form outer electron beam pass-through holes, wherein each one of the electrostatic field controlling electrodes is disposed in contact with the inside of the second focusing electrode and the anode. The electrode depth from the rim portion of the second focusing electrode and the anode and the thickness of the center frame and the outer frames in the travel direction of the electron beams are adjusted to minimize deflection aberrations of the three electron beams.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 7:
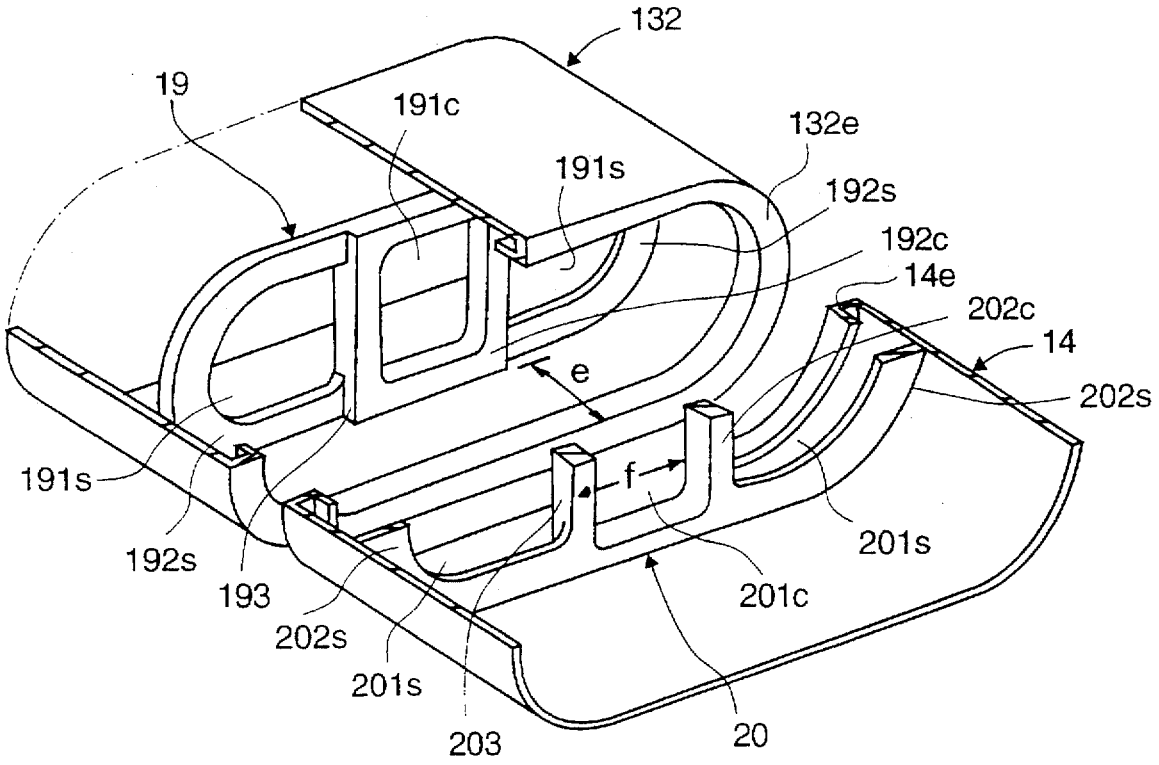
FIG. 7 illustrates a perspective view of a second focusing electrode and an anode each having an electrostatic field controlling electrode in accordance with a first preferred embodiment of the present invention, in partial cut away view.

Reference will now be made in detail to the preferred embodiments of the present invention, examples of which are illustrated in the accompanying drawings. In following explanations, parts identical to the part of the conventional electrode system are represented with the same part numbers. FIG. 7 illustrates a perspective view of a second focusing electrode and an anode each having an electrostatic field controlling electrode in accordance with a first preferred embodiment of the present invention, in partial cut away view, and FIG. 8 illustrates a perspective view of the electrostatic field controlling electrode shown in FIG. 7.

Figure 8:
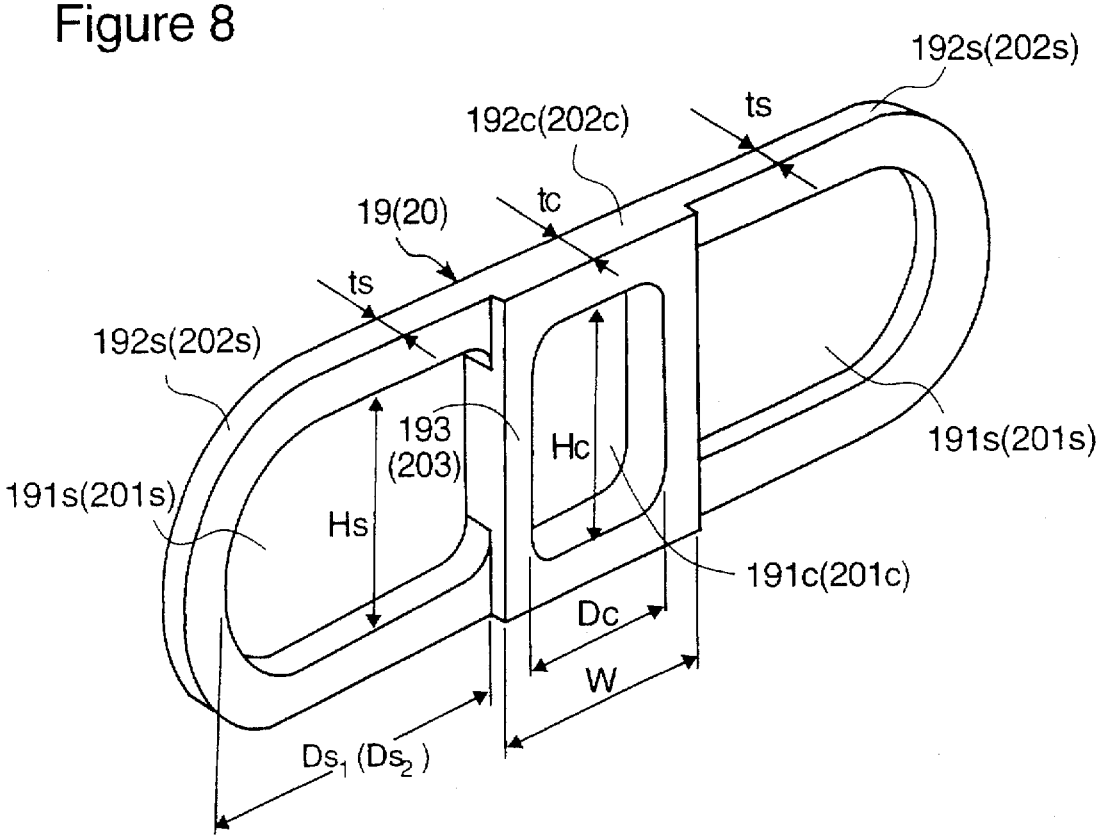
FIG. 8 illustrates a perspective view of the electrostatic field controlling electrode shown in FIG. 7.

Referring to FIGS. 7 and 8, the electrostatic field controlling electrodes 19 and 20 in accordance with a first preferred embodiment of the present invention includes frame parts 192 and 202 having three electron beam pass-through holes 191 and 201 formed therein, outer circumferences of which are in contact with inside of a second focusing electrode 132 and an anode 14 respectively. Each of the frame parts 192 and 202 has a center frame **192*c* and 202*c* having a center electron beam pass through hole 191*c* and 201*c* formed therein, and outer frames 192*s* and 202*s* having outer electron beam pass-through holes 192*s* and 201*s* formed therein. Though smaller than the outer electron beam pass-through holes 191*s* and 201*s*, the center electron beam pass through hole 191*c* and 201*c* is enlarged to the maximum extent possible minimizing variation of a spot size of the center electron beam on a screen. A thickness tc of the center frame surrounding the center electron beam pass-through hole 191*c* and 201*c* in the direction of the electron beam travel is formed thicker than the thickness ts of the outer frames 192*s* and 202*s* of the outer electron beam pass-through holes 191*s* and 201*s* in the direction of the electron beam travel. Moreover, it is preferable that a stepped portion 193 and 203 of the center electron beam pass-through hole formed by the difference in thickness tc and ts of the center and outer frames 192*c*, 192*s*, 202*c* and 202*s* is projected only on one side of the electrostatic field controlling electrode, and it is particularly preferable to arrange the electrostatic field controlling electrodes 19 and 20 such that the stepped portions 193 and 203 face each other for strengthening action of the electric field. The increased focusing power for the electron beams due to the center frames being closer to their respective rim portion than the outer frames, which arises from these thickness differences, compensates for the weakened focusing power caused by the formation of large center electron beam pass-through holes. This difference in thickness between tc and ts is greatly varied depending on the depth of the electrostatic field controlling electrode 19 and 20 in the second focusing electrode 132 and anode 14 and the size of the center electron beam pass-through hole 191*c* and 201*c*. It is preferable that the thickness tc of the center frame is greater than the thickness ts of the outer frame by a ratio ranging between 10–50%. Since the OCV is reduced if horizontal diameters Ds1 of the outer frames 192*s* of the electrostatic field controlling electrode 19 in the second focusing electrode 132 are decreased and horizontal diameters Ds2 of the outer frames 202*s* of the electrostatic field controlling electrode 20 in the anode 14 are increased, the horizontal diameter Ds1 is formed smaller than the horizontal diameter Ds2. When the electrostatic field controlling electrodes 19 and 20 are disposed deeper away from the rim portions 132*e* and 14*e* of the second focusing electrode and the anode, in order to form a greater main focusing electrostatic lens, an overall thicknesses tc and ts of the center and outer frames 192*c*, 192*s*, 202*c* and 202*s* are made thinner to weaken the power of the electric field formed by the frame parts 192 and 202** for preventing overfocusing and underfocusing of the electron beams. The center and outer electron beam pass-through holes are preferably rectangular with rounded corners.

A second embodiment of the present invention includes a stepped portion of the center frame narrower than that of the first embodiment and a third embodiment of the present invention includes a stepped portion of the center frame wider than that of the first embodiment.

Figure 9:
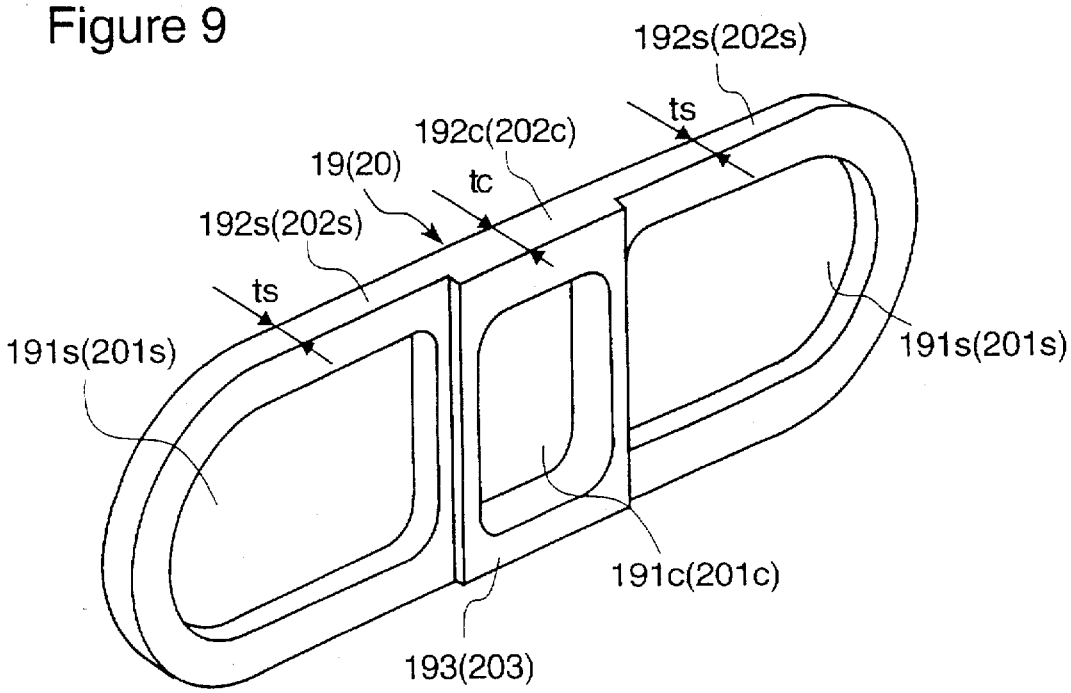
FIG. 9 illustrates a perspective view of an electrostatic field controlling electrode in accordance with a second preferred embodiment of the present invention; and, FIG. 10 illustrates a perspective view of an electrostatic field controlling electrode in accordance with a third preferred embodiment of the present invention.

FIG. 9 illustrates a perspective view of an electrostatic field controlling electrode in accordance with the second preferred embodiment of the present invention, wherein the width of the stepped portion 193 and 203 is narrower than the width of the center frame **192*c* and 202*c***.

Figure 10:
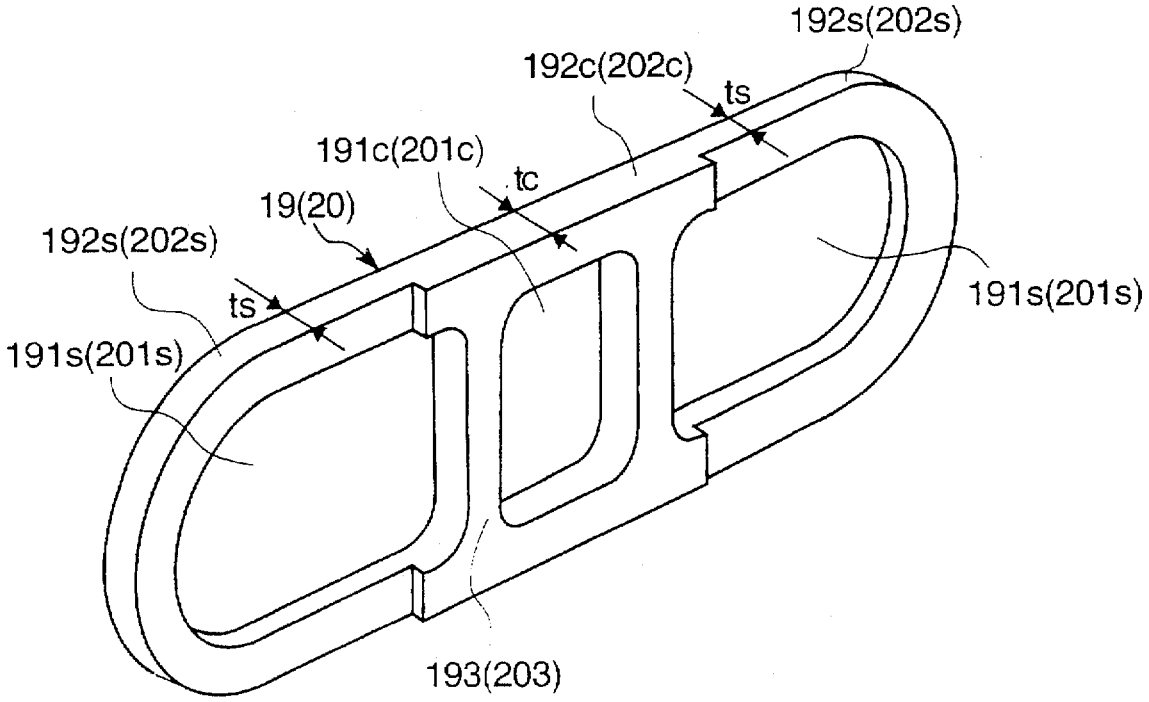

FIG. 10 illustrates a perspective view of an electrostatic field controlling electrode in accordance with the third preferred embodiment of the present invention, wherein the width of the stepped portion 193 and 203 wider than the width of the center frame **192*c* and 202*c***.

Approximate dimensions of the electrostatic field controlling electrode of the first embodiment are as follows.

The electrostatic field controlling electrode in the second focusing electrode.

- Thickness tc of the center electron beam pass-through hole: 0.7 mm
- Thickness tc of the outer electron beam pass-through hole: 0.5 mm
- Horizontal width Dc of the center electron beam pass-through hole: 4.4 mm
- Vertical diameter Hc of the center electron beam pass-through hole: 7.0 mm
- Horizontal diameter Ds1 of the outer electron beam pass-through hole: 7.0 mm
- Vertical width Hs of the outer electron beam pass-through hole: 8.0 mm
- Width of the bridge: 5.8 mm The electrostatic field controlling electrode in the anode.

Thickness tc of the center electron beam pass-through hole: 0.7 mm

Thickness tc of the outer electron beam pass-through hole: 0.5 mm

Horizontal width Dc of the center electron beam pass-through hole: 4.2 mm

Vertical width Hc of the center electron beam pass-through hole: 7.0 mm

Horizontal diameter Ds2 of the outer electron beam pass-through hole: 7.5 mm

Vertical diameter Hs of the outer electron beam pass-through hole: 8.0 mm

Width of the bridge: 5.6 mm

Disposed depth e of the electrostatic field controlling electrode in the second focusing electrode: 4.2 mm Disposed depth f of the electrostatic field controlling electrode in the anode: 4.0 mm In the electrostatic field controlling electrode of the present invention, the center frame serves as the conventional electrostatic field controlling electrode, the outer frames reduce an OCV, and the center frame is made thicker than the outer frames to strengthen the power acting on the center electron beam reducing the difference in the power acting on the outer beam.

Figure 1:
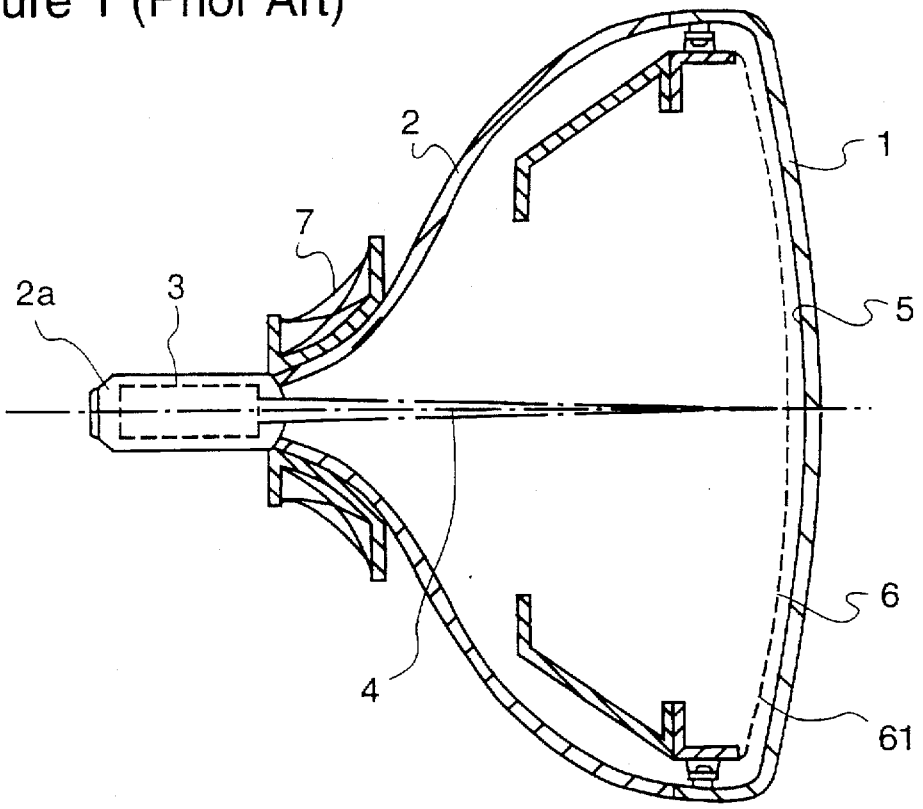
Figure 1 (Prior Art)
FIG. 1 illustrates an outline of the color cathode ray tube with a conventional in-line type electron gun.
Figure 2:
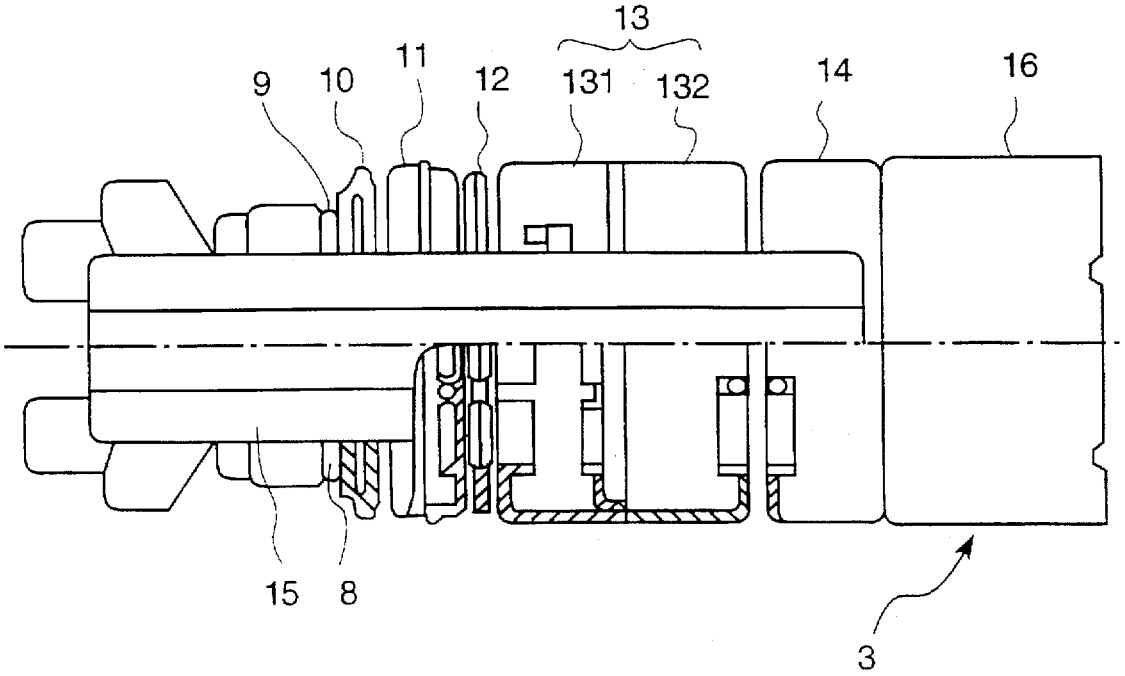
Figure 2 (Prior Art)
FIG. 2 illustrates the conventional in-line type electron beam shown in FIG. 1 in a partial cut-away view.
Figure 3:
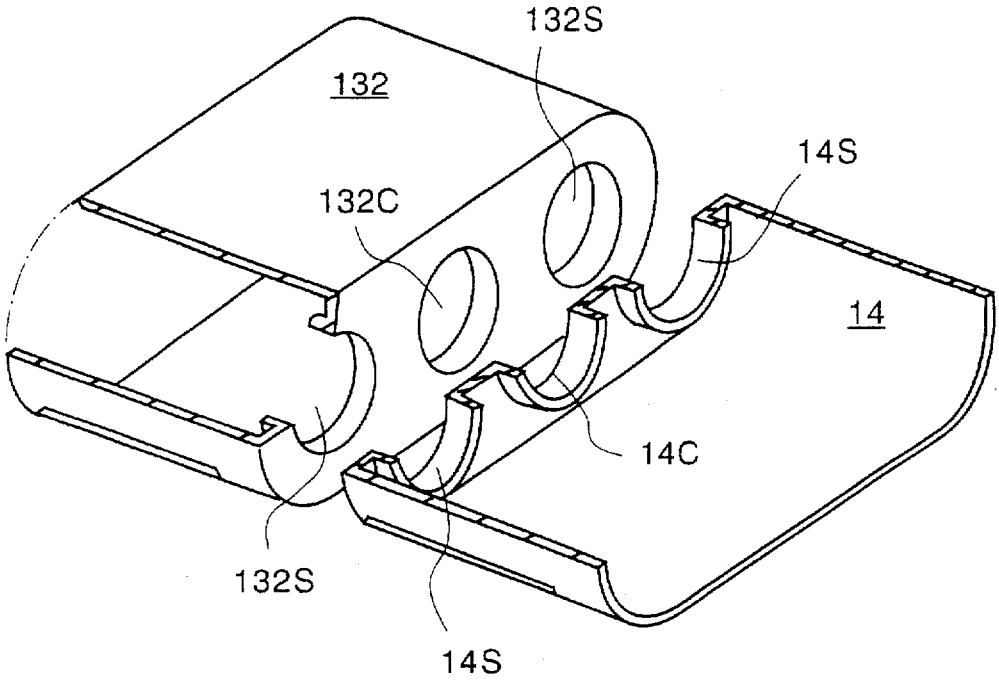
Figure 3 (Prior Art)
FIG. 3 illustrates a perspective view of an example of a conventional second focusing electrode and an anode in a partial cut away view.
Figure 4:
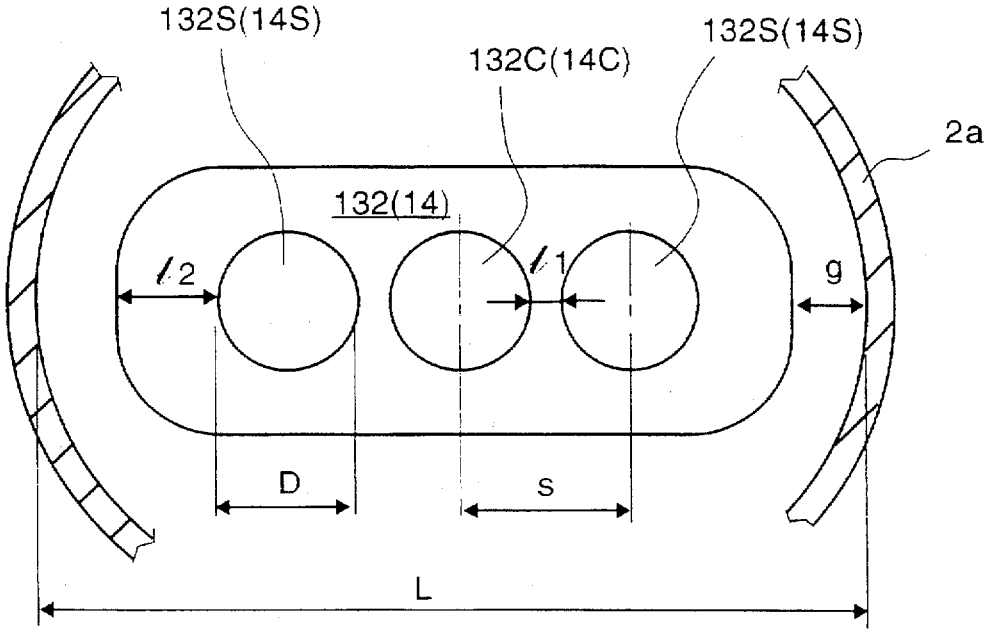
Figure 4 (Prior Art)
FIG. 4 illustrates a frontal section of the system shown in FIG. 3 together with the neck portion for reference.
Figure 5:
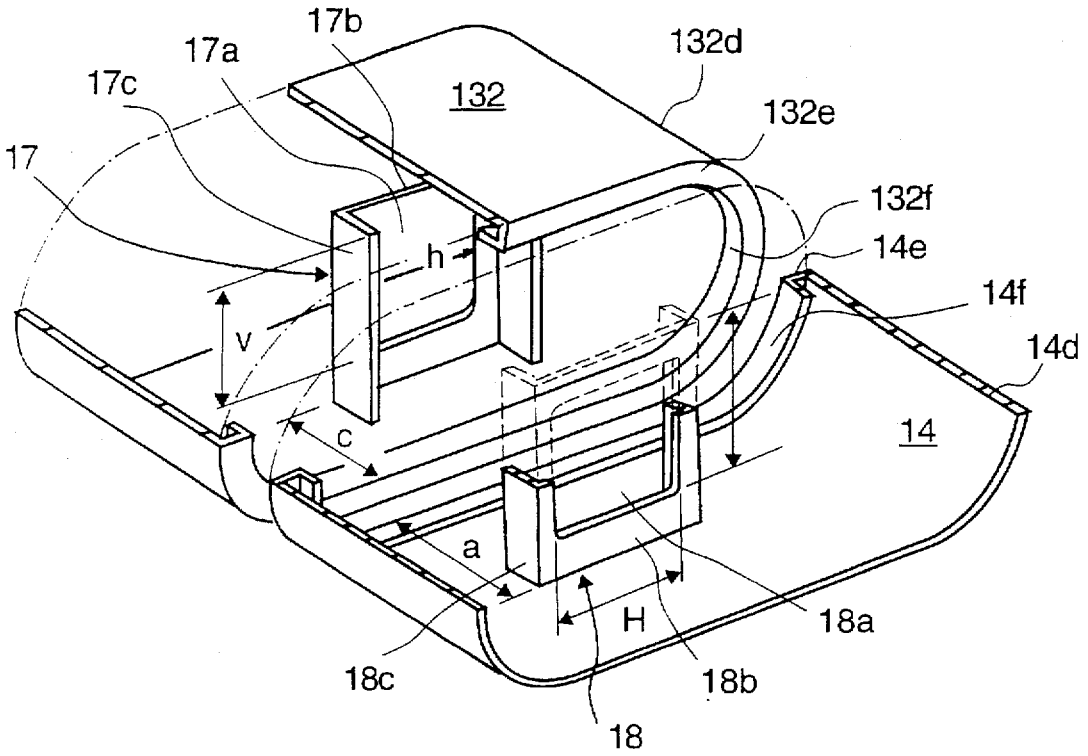
Figure 5 (Prior Art)
FIG. 5 illustrates a perspective view of another example of a convention second focusing electrode and the anode having electrostatic field controlling electrodes in a partial cut away view.
Figure 6:
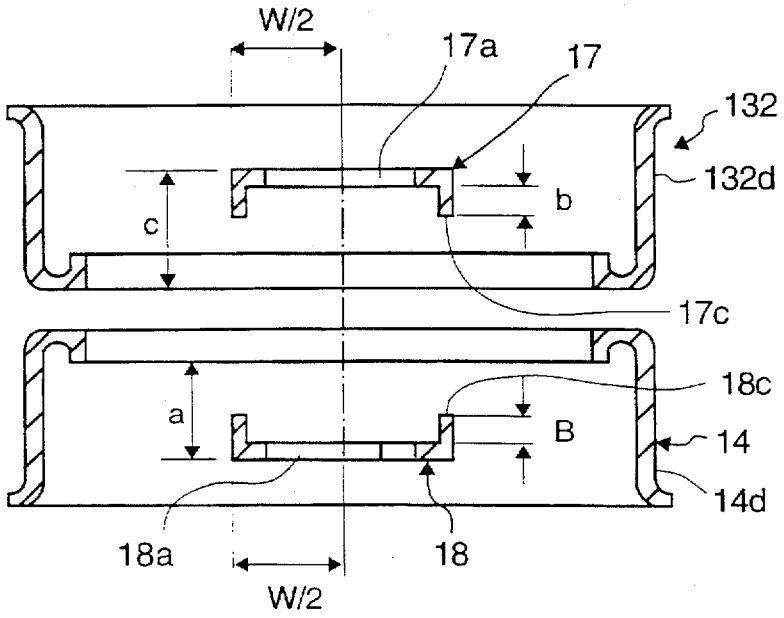
Figure 6 (Prior Art)
FIG. 6 illustrates a section of the conventional second focusing electrode and anode shown in FIG. 5.

From an experiment with the electrostatic field controlling electrodes of the present invention mounted in the second focusing electrode and the anode respectively, an OCV of −1 mm was obtained, and, in comparison to the conventional electron gun shown in FIG. 5, a reduction of approximately 15% in the spot size of the electron beam at central portion of the screen and a reduction of 10% in the spot size of the electron beam at periphery of the screen were obtained with improvements in astigmatisms and OCVs on the screen, especially in periphery of the screen.

What is claimed is:

1. An electrode system for controlling an electrostatic field in an electron gun for a color cathode ray tube including electron beam emitting means for emitting three electron beams, first and second focusing electrodes and an anode disposed opposite to the second focusing electrode for focusing and accelerating the three electron beams onto a screen, the electrode system for controlling an electrostatic field comprising:

electrostatic field controlling electrodes disposed in the anode and the second focusing electrode, each of the electrostatic field controlling electrodes comprising:

a solid center frame having a top portion, a bottom portion and sides, the top and bottom portions and sides positioned to form a center electron beam pass-through hole; and, solid outer frames extending from the sides of the center frame to form outer electron beam pass-through holes, wherein the electrostatic field controlling electrodes are disposed in contact with inside surfaces of the second focusing electrode and the anode, and wherein (i) a disposed depth from a rim portion of the second focusing electrode and the anode to the electrodes and (ii) a thickness of a stepped portion of the center frame formed by a thickness difference between the center frame and the outer frames in a travel direction of the electron beams are adjusted to minimize deflection aberrations of the three electron beams.

2. An electrode system for controlling an electrostatic field as claimed in claim 1, wherein the width of the stepped portion of the center frame is narrower than a width of the center frame.

3. An electrode system for controlling an electrostatic field as claimed in claim 1, wherein the width of the stepped portion of the center frame is wider than a width of the center frame.

4. An electrode system for controlling an electrostatic field as claimed in one of claims 1, 2, or 3, wherein a thickness of the center frame is thicker than a thickness of the outer frame.

5. An electrode system for controlling an electrostatic field as claimed in claim 4, wherein the stepped portion of the center frame is formed only on one side of the electrostatic field controlling electrode.

6. An electrode system for controlling an electrostatic field as claimed in claim 5, wherein the electrostatic field controlling electrodes in the second focusing electrode and the anode are arranged such that the stepped portions face each other.

7. An electrode system for controlling an electrostatic field as claimed in claim 6, wherein the center electron beam pass-through hole is smaller than the outer electron beam pass-through holes.

8. An electrode system for controlling an electrostatic field as claimed in claim 7, wherein horizontal diameters of the outer electron beam pass-through holes in the second focusing electrode are smaller than horizontal diameters of the outer electron beam pass-through holes in the anode.

9. An electrode system for controlling an electrostatic field as claimed in claim 8, wherein the center, and outer electron beam pass-through holes are rectangular with rounded corners.

10. An electrode system for controlling an electrostatic field in an electron gun for a color cathode ray tube including electron beam emitting means for emitting three electron beams, a first focusing electrode, a second focusing electrode having a rim portion at an end thereof, and an anode having a rim portion at an end thereof, the electrode system comprising:

a first electrostatic field controlling electrode disposed within the second focusing electrode at a predetermined distance from the rim portion of the second focusing electrode, comprising:

an electrode frame having a center electron beam pass-through hole and two outer electron beam pass-through holes positioned on either side of the center pass-through hole, a bridge on each side of the center pass-through hole to separate the center pass-through hole from the outer pass-through holes, a stepped portion of the electrode frame integrally surrounding the center pass-through hole; and a second electrostatic field controlling electrode disposed within the anode at a predetermined distance from the rim portion of the anode, comprising:

an electrode frame having a center electron beam pass-through hole and two outer electron beam pass-through holes positioned on either side of the center pass-through hole, a bridge on each side of the center pass-through hole that separate the center pass-through hole from the outer pass-through holes, a stepped portion of the electrode frame integrally surrounding the center pass-through hole;

wherein the stepped portion of the electrode frame of the first electrostatic field controlling electrode faces the stepped portion of the second electrostatic field controlling electrode.

* * * * *